United States Patent [19]

Sorenson

[11] 4,408,106

[45] Oct. 4, 1983

[54] PUSHBUTTON SWITCH

[75] Inventor: Richard W. Sorenson, Avon, Conn.

[73] Assignee: Carlingswitch, Inc., West Hartford, Conn.

[21] Appl. No.: 360,474

[22] Filed: Mar. 22, 1982

[51] Int. Cl.[3] ..... H01H 13/28; H01H 13/60

[52] U.S. Cl. ..... 200/68; 200/153 J; 200/241

[58] Field of Search ..... 200/67 G, 68, 153 J, 200/252, 260, 241

[56] References Cited

U.S. PATENT DOCUMENTS

| | | | |
|---|---|---|---|
| 2,405,679 | 8/1946 | Wahlstrom | 200/153 J |
| 2,469,337 | 5/1949 | Kohl | 200/153 J |
| 3,491,218 | 1/1970 | Robbins | 200/68 |
| 3,619,528 | 11/1971 | Sorenson | 200/153 J |
| 4,095,070 | 6/1978 | Simpson | 200/67 G |
| 4,170,725 | 10/1979 | Farrell | 200/241 |

FOREIGN PATENT DOCUMENTS

| | | | |
|---|---|---|---|
| 66165 | 10/1927 | Sweden | 200/153 J |

*Primary Examiner*—John W. Shepperd
*Attorney, Agent, or Firm*—McCormick, Paulding & Huber

[57] ABSTRACT

A pushbutton switch has a single spring for return of the button, and for the lost motion required to operate a movable contact element between two switch conditions. A staple shaped strut has its head portion loosely received in a recess of the button, and its leg portions cam the movable contact, against the force of the spring, to achieve a desired initial rocking and final sliding motion for the movable contact element relative to a fixed center contact.

16 Claims, 13 Drawing Figures

PUSHBUTTON SWITCH

This invention relates generally to pushbutton or plunger type electric switches of the type having a pushbutton to achieve alternative switch conditions in sequence in order to energize two different circuits from the same switch, or to achieve a simple on/off function. More particularly, the pushbutton switch of the present invention seeks to avoid the need for a multitude of component parts within the switch, and to avoid the attendant high costs of production and assembly characteristic of pushbutton switches of this general type.

SUMMARY OF THE INVENTION

The pushbutton switch described herein has a single spring for achieving both return of the pushbutton or plunger, and for achieving the lost motion function required in such switches to operate the movable contact element between the two switch conditions. Fixed contacts are provided in the bottom wall of the switch housing cavity, and a center fixed contact has its upper end raised above the upper end of other fixed contacts so that a movable contact element can slidably and pivotally engage the upper end of the fixed contact in response to movement of the pushbutton downwardly from its normal up position. A staple shaped strut has its head portion loosely received in a recess of the pushbutton, and leg portions of this strut cam the movable contact element in order to achieve the desired motion against the force of the single spring acting between the head portion of the strut and a center portion of the movable contact. The improved pushbutton switch construction so provided has fewer component parts than prior art pushbutton switches generally, resulting in less expensive cost of manufacturer for these component parts and further savings due to the lower cost of assembly in the production of such an improved switch.

DETAILED DESCRIPTION OF FIGS. 1–8

Figure 1:
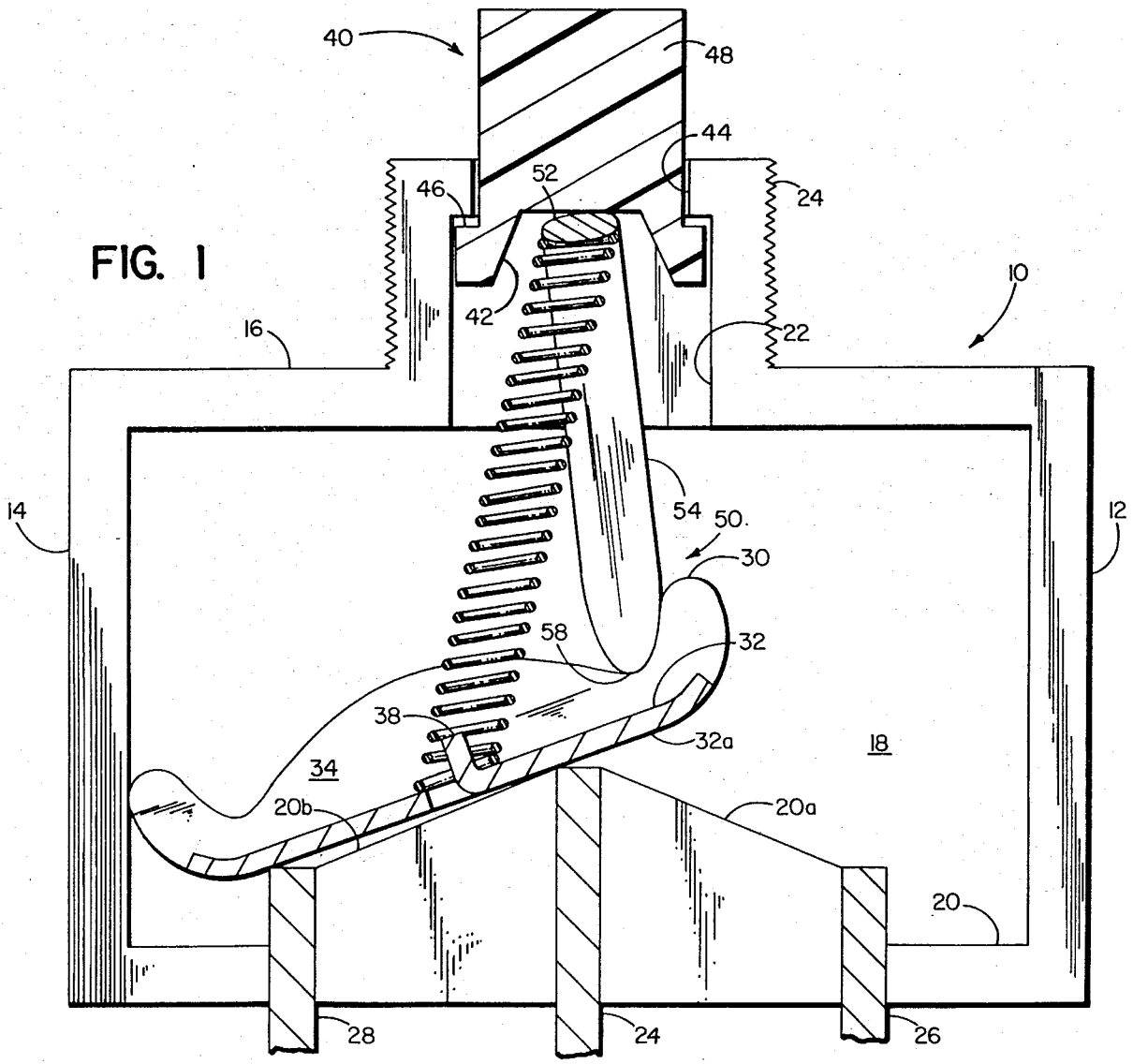
FIG. 1 is a vertical cross sectional view showing one condition for an improved pushbutton switch incorporating the present invention.

Turning now to the drawings in greater detail, the pushbutton switch of FIGS. 1–8 comprises a housing, designated generally at 10, which housing may be made from a pair of identical half-shell case portions, each of which comprise end walls 12 and 14, top walls 16, side walls 18 and bottom walls 20. All of these switch case walls cooperate to define a switch cavity communicating with a top opening 22. The switch case half-shells may be provided with alternately shaped protruding pins and accommodating pin openings (not shown) in order to provide a conveniently assembled housing for the components to be described. A threaded boss 24 may be integrally formed with these switch case half-shells, or may in the alternative be formed of metal and secured to the switch case housing as shown for example in prior art U.S. Pat. No. 3,619,528. The housing itself is preferably made of a suitable insulating material such as nylon, Bakelite or the equivalent.

Fixed contacts are provided in the bottom wall of the switch housing cavity and a center fixed contact has its upper end located above the upper ends of end contacts 26 and 28. The bottom wall 20 of the switch case includes ramp surfaces **20*a*, and 20*b*, which surfaces slope in opposite directions to guide a movable contact element 30 during movement thereof within the switch case in a direction from left to right or right to left in response to pressing downwardly on the plunger or pushbutton 40. These fixed contacts 24, 26 and 28** are held between the switch case halves or otherwise secured in the bottom wall of the switch case cavity in accordance with convention practice.

Figure 4:
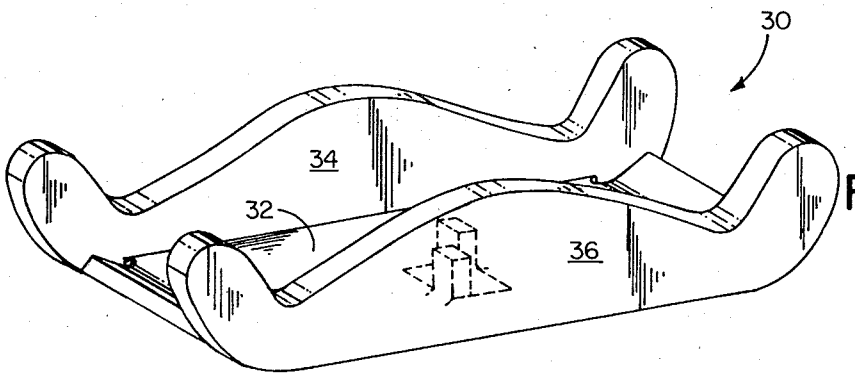
FIG. 4 is a perspective view of the movable contact element illustrated in the switch of FIGS. 1–3.
Figure 5:
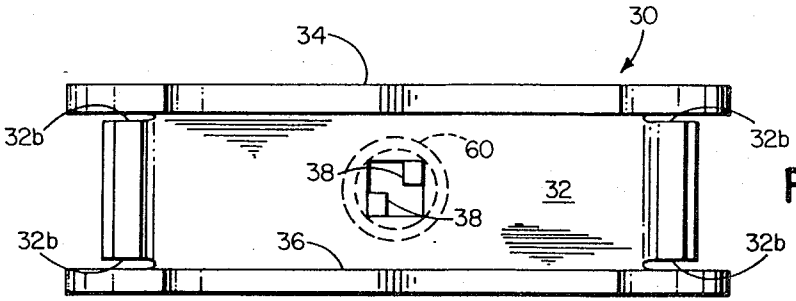
FIG. 5 is a plan view of the movable contact element of FIG. 4.

The movable contact element 30, best shown in FIGS. 4 and 5 comprises a generally channel shaped element having a bottom wall 32 and a generally flat planar lower surface of said bottom wall, as indicated generally at **32*a*, which wall 32*a* pivotally and slidably engages the upper end of center contact 24, and which wall 32*a* is guided by the ramp surfaces 20*a* and 20*b* of the switch case cavity bottom wall 20. The channel shaped movable contact element 30 further includes upstanding side walls 34 and 36 integrally connected to the bottom wall along a major portion of their length as best shown in FIG. 5, but with relieved portions 32*b*, 32*b*, in order to provide a slight upturn of wall 32*a* at the ends of the movable contact element 30 to assure smooth contact with the upper ends of fixed end contacts 26 and 28. Still with reference to the movable contact element 30 of FIGS. 4 and 5, these side walls 34 and 36 define camming surfaces along the upper edges thereof, each of which camming surfaces has a contour identical to the other, and each of which is adapted to be engaged by the lower end portions of strut means 50 to be described. In the description to follow it will be apparent that the upturned end portions 34*a* and 34*b* (and 36*a* and 36*b*) prevent disengagement between the lower ends 58, 58 of strut 50 and the element 30. These portions 34***a*, 34*b*, 36*a* and 36*b* also assist in initial movement of the element 30 in response to downward movement of pushbutton 40. Finally, there is provided, centrally of the bottom wall 32 of contact element 30, spring seating means in the form of upstanding tabs 38, 38.

Figure 2:
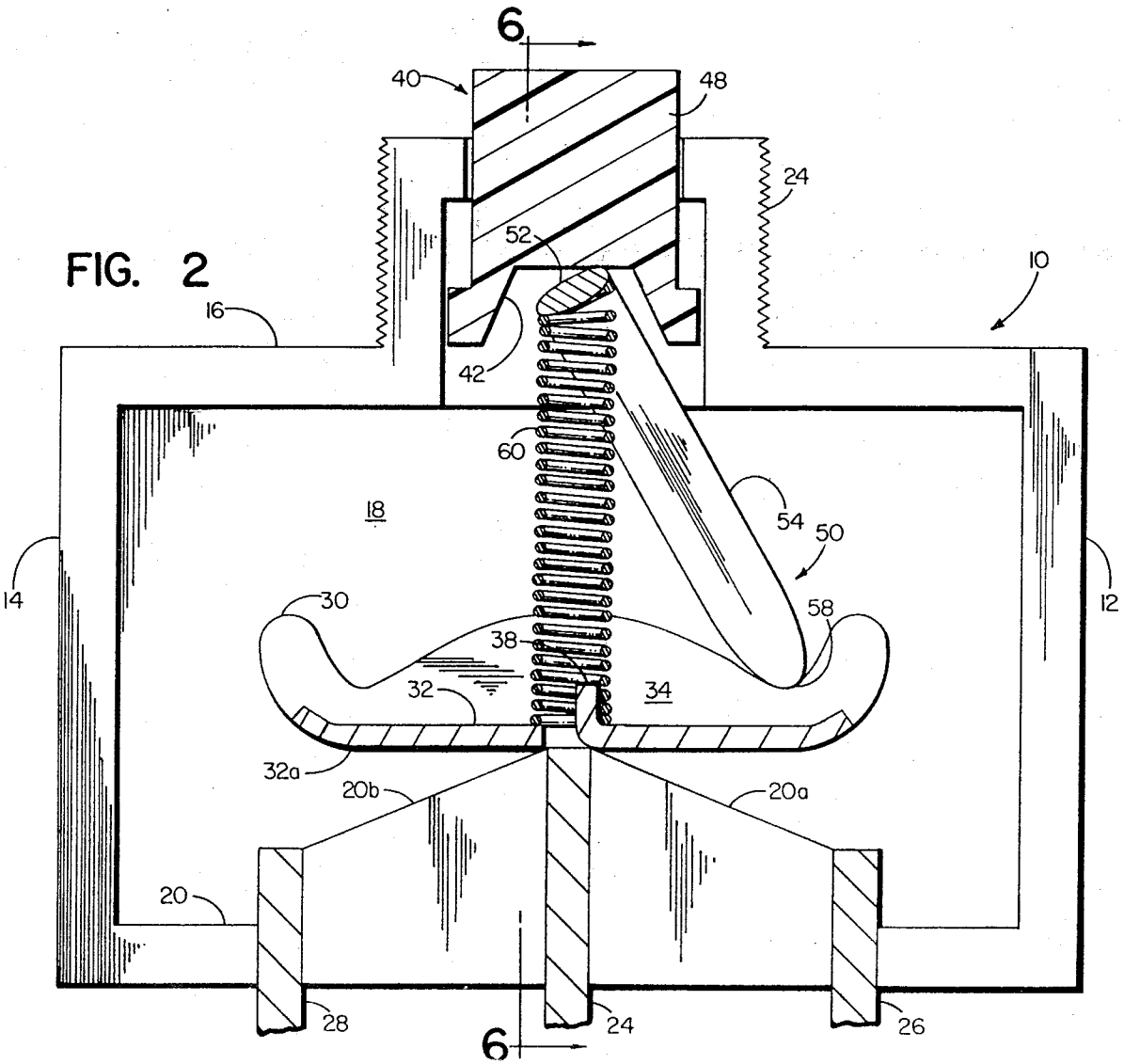
FIG. 2 is a view similar to FIG. 1 but illustrating the pushbutton and component parts of the switch in an intermediate position resulting from downward movement of the pushbutton itself.
Figure 3:
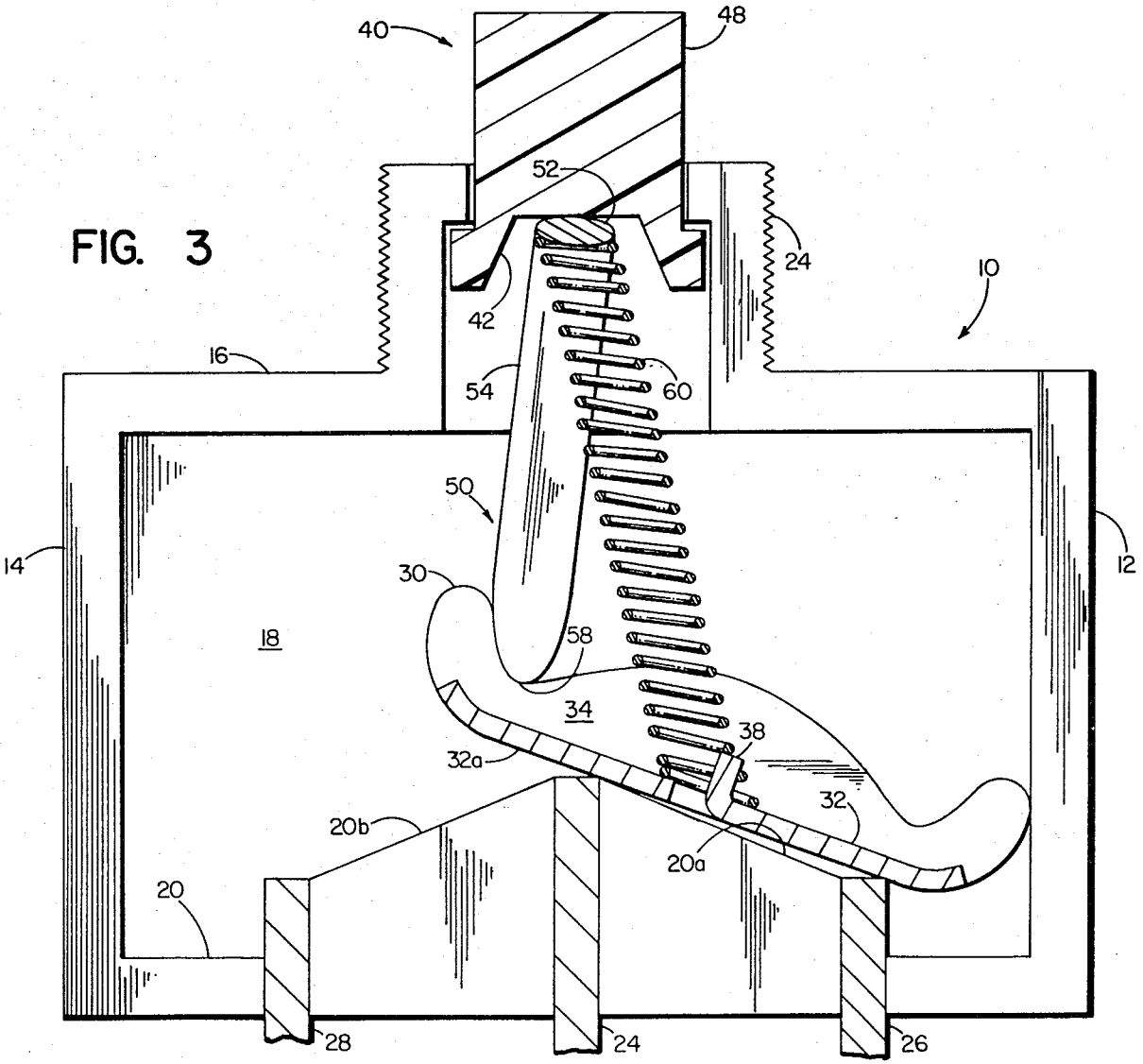
FIG. 3 is a view similar to FIGS. 1 and 2 but taken at a slightly later instant of time after the bushbutton has been released, and after the movable contact has shifted to an alternative switch condition.
Figure 8:
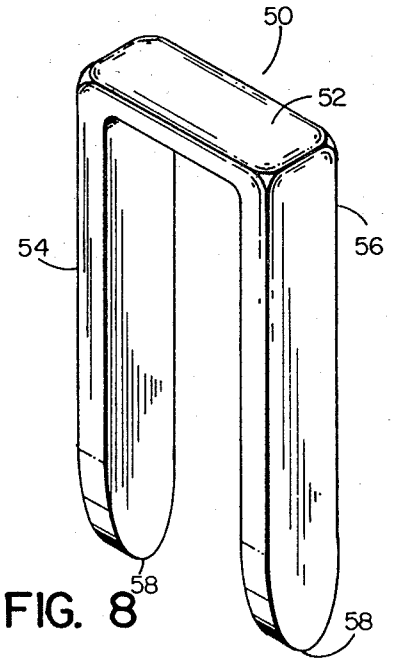
FIG. 8 is a perspective view of the staple shaped strut provided in the switch of FIGS. 1, 2, 3 and 6.
Figure 6:
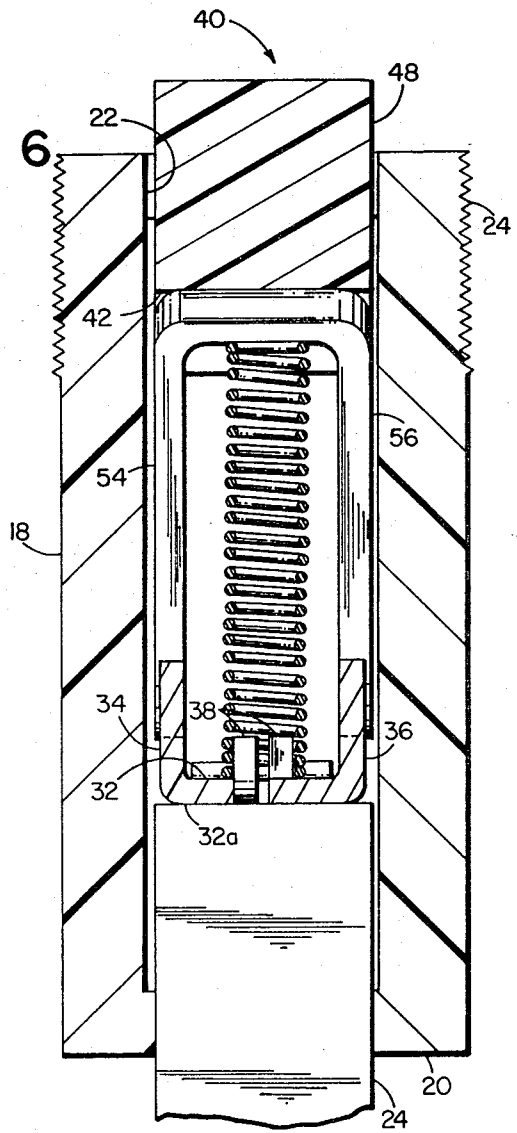
FIG. 6 is a vertical sectional view taken generally on the line 6—6 of FIG. 2.

The strut means 50 preferably has a generally staple shape as shown in FIG. 8 with a head portion 52 at its upper end and depending leg portions 54 and 56 of equal length and similar configuration. Lower ends 58, 58 of the leg portions are adapted to engage the upwardly facing camming surfaces defined by the side walls, 34 and 36 respectively, of the contact element 30. These lower ends 58, 58 of depending leg portions 54 and 56 can be seen from FIGS. 1 and 3 to be displaced with respect to a vertical plane defined by the center contact 24 so that downward movement of pushbutton 40 will cause contact element 30 to pivot about the upper end of center contact 24 from either of the positions shown in FIGS. 1 and 3 to assume an unstable position, such as that depicted in FIG. 2. FIG. 2 represents an intermediate position achieved during downward pressure on the pushbutton 40 and represents an unstable position between that of FIGS. 1 or 3, that is prior to element 30 reaching the stable positions depicted in these views. Each camming surface edge includes a convex center segment such that the lower end of each strut leg is cammed away from the plane of the center contact 24 as the pushbutton 40 is moved downwardly from either switch position (FIG. 1 or FIG. 3). Concave end segments 34*a*, 34*b*, 36*a* and 36*b* of each camming surface edge are continuously contoured with respect to this convex center segment and serve to stop the strut legs and to locate the strut for achieving the next alternative switch condition in response to successive downward movements of the pushbutton. These concave end segments locate strut 50 in either the FIG. 1 or the FIG. 3 position.

A single coil type compression spring 60 acts between the underside of the head portion 52 of strut element 50 and the center portion of movable contact 30 to serve not only as a return spring for the pushbutton 40, but also to hold movable contact 30 in the positions shown for it in FIGS. 1 and 3 respectively. Spring 60 will also yield when pushbutton 40 is depressed, that is when strut 50 exerts a downward force on the free end of contact element 30 as shown in FIGS. 1 and 3 to alter the condition of the switch. The lower end of the spring 60 is secured to the center portion of contact element 30 by the tangs 38, 38 described previously. The upper end of spring 60 is loosely received in a downwardly open recess provided for this purpose in the pushbutton 40. This recess 42 also receives and loosely retains the upper end or head portion 52 of the staple shape strut 50.

Figure 7:
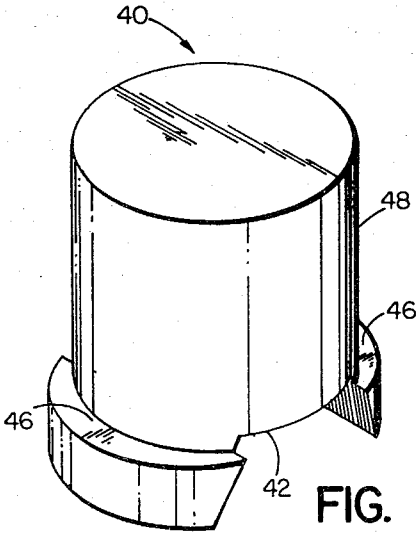
FIG. 7 is a perspective view of the pushbutton or plunger illustrated in the assembled switch of FIGS. 1, 2, 3 and 6.

Pushbutton 40, best shown in FIG. 7, has a cylindrical upper portion 48 slidably received in opening 22, and projecting portions 46, 46 at its lower end to act as stop surfaces and to define the normal position for pushbutton 40 as shown in FIGS. 1 and 3. The downwardly open recess 42 receives the head 52 of strut 50, and also the top of spring 60.

As so constructed and arranged downward pressure on pushbutton 40, from the FIG. 1 or FIG. 3 position and through that of FIG. 2, will achieve rocking or pivotal motion of the movable contact element 30. As suggested in FIG. 2 such rocking motion from the FIG. 1 to the FIG. 2 position is necessarily followed by sliding motion of the contact element 30 along the ramp surface 20*a* as the movable contact element 30 reaches the FIG. 3 position. In order to change the condition of the switch from that of FIG. 3 to FIG. 1 contact element 30 would again move through the position shown for it in FIG. 2 but staple shape strut member 50 would be in a position essentially comprising a mirror image of that depicted in FIG. 2 when element 30 moves through the intermediate position shown in this view. As will be seen from a comparison of FIGS. 1, 2 and 3 the position for spring 60 changes during the above described motion for movable contact element 30 between the limit positions for the spring as shown in FIGS. 1 and 3 through the intermediate unstable position depicted for it in FIG. 2. As a result of the above described construction a positive action pushbutton switch is provided with fewer internal component parts than is possible with prior art switches generally. This result is achieved without sacrifice to the durability and operative "feel" of the pushbutton switch described herein.

It should be understood that other embodiments of the pushbutton switch described herein can be provided. Whereas the switch shown has two end contacts located in equally spaced relation to the center contact 24, a single end contact might be provided with the opposite end contact being omitted to provide a simple on/off switch. In the switch shown, the end contacts 26 and 28 may be associated with two separate circuits which are to be selectively energized through a common power line connected to the center contact 24. In the switch with only one end contact a single circuit could be energized and denergized.

DETAILED DESCRIPTION OF FIGS. 9–13

The pushbutton switch of FIGS. 9–13 also includes a housing 100, which is preferably made from a pair of identical half sections or shell case portions conventionally joined together with fasteners or the like. Integral end walls 112 and 114 are provided with top and bottom walls 116 and 118 joined at the case corners and to the side walls (one shown). An integrally defined boss 124 has an opening 144/122 slidably receiving the pushbutton 140. Fixed contacts 24, 26 and 28 are provided in the bottom wall 118 but the inside of said wall 118*a* does not deffine ramp surfaces such as shown at 20*a* in FIGS. 1–3.

Still with reference to the switch housing 100, side wall 110 has an inwardly projecting portion 110*a* which defines oppositely inclined camming or ramp surfaces 120*a* and 120*b*. These surfaces 120*a* and 120*b* are adapted to be selectively engaged by projecting portions 154*a* and 156*a* provided on the outside surfaces of the legs 154 and 156 respectively. While the lower ends 158, 158 of these legs do engage the upper edges of the movable contact's side walls 134 and 136 (FIG. 9) it is an important feature of the switch shown in FIGS. 9–13 that the staple shaped strut 150 is more positively controlled in its movement through the FIG. 10 position than the strut 50 of FIG. 2.

Figure 9:
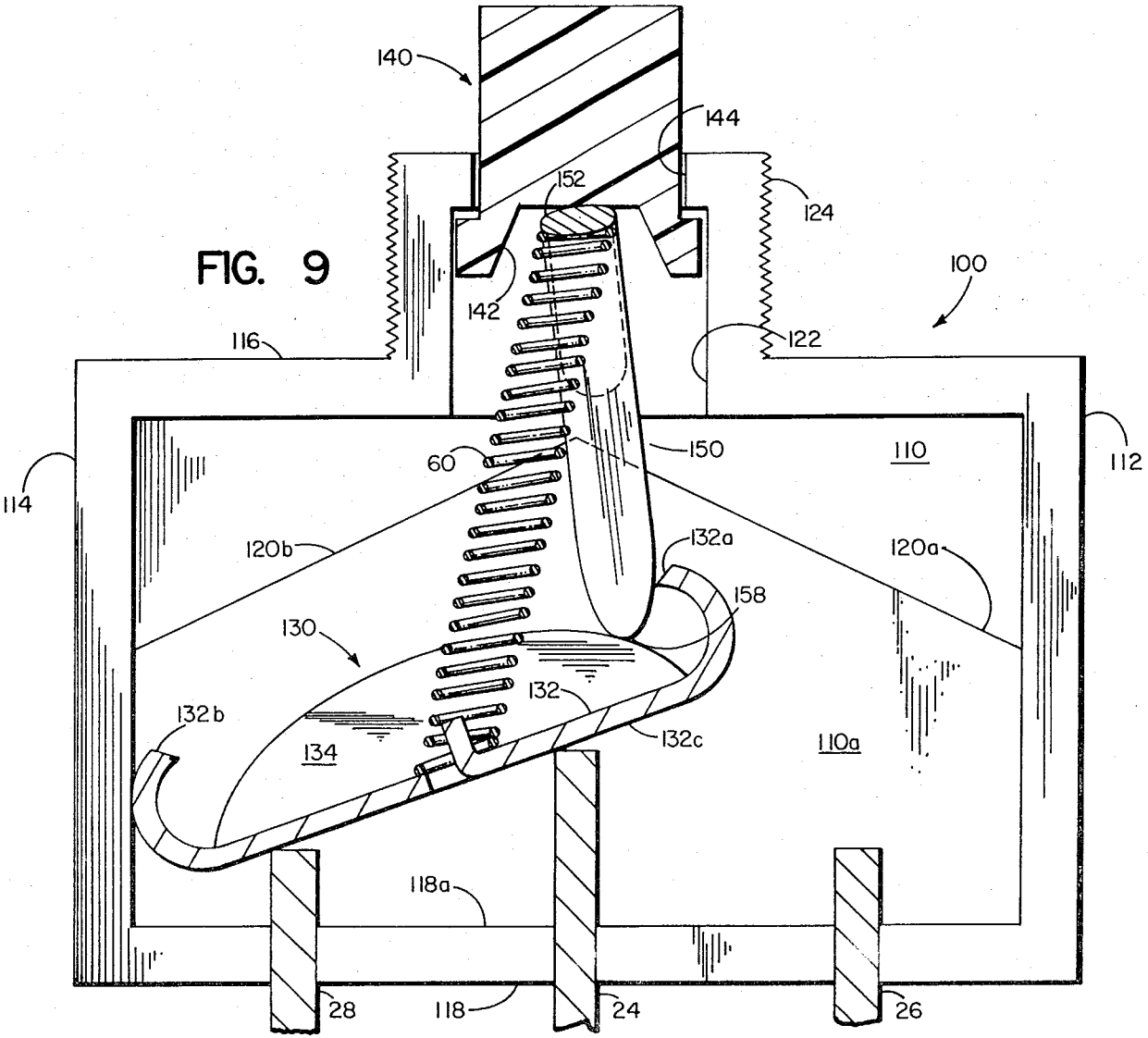
FIG. 9 is a vertical cross sectional view of an alternative embodiment for an improved pushbutton switch incorporating the present invention.
Figure 12:
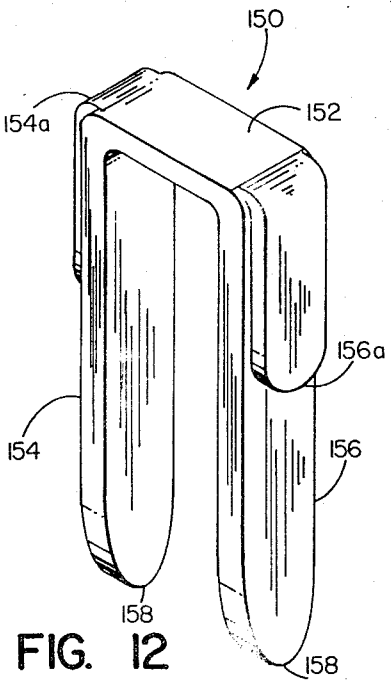
FIG. 12 is a perspective view of the staple shaped strut provided in the switch of FIGS. 9–11.
Figure 11:
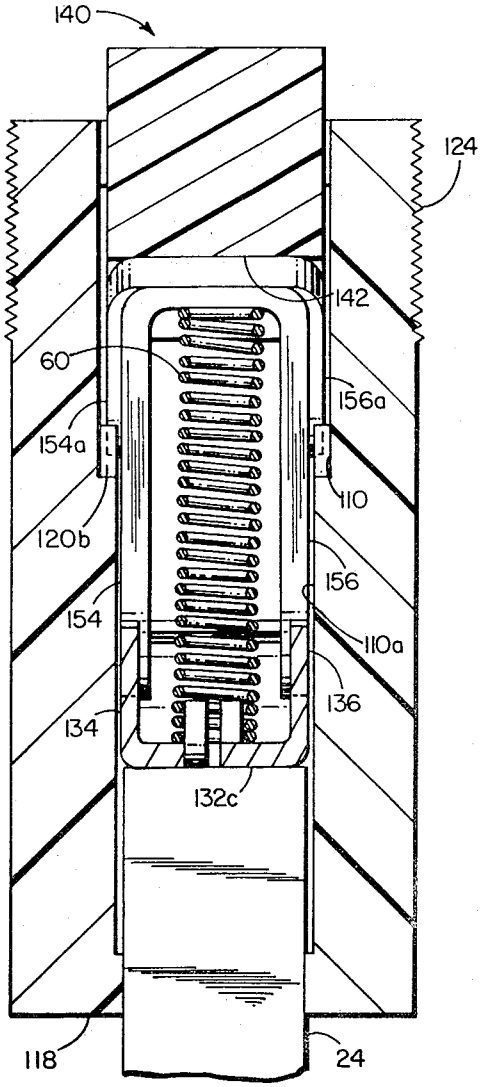
FIG. 11 is a vertical sectional view taken generally on the line 11—11 of FIG. 10.
Figure 13:
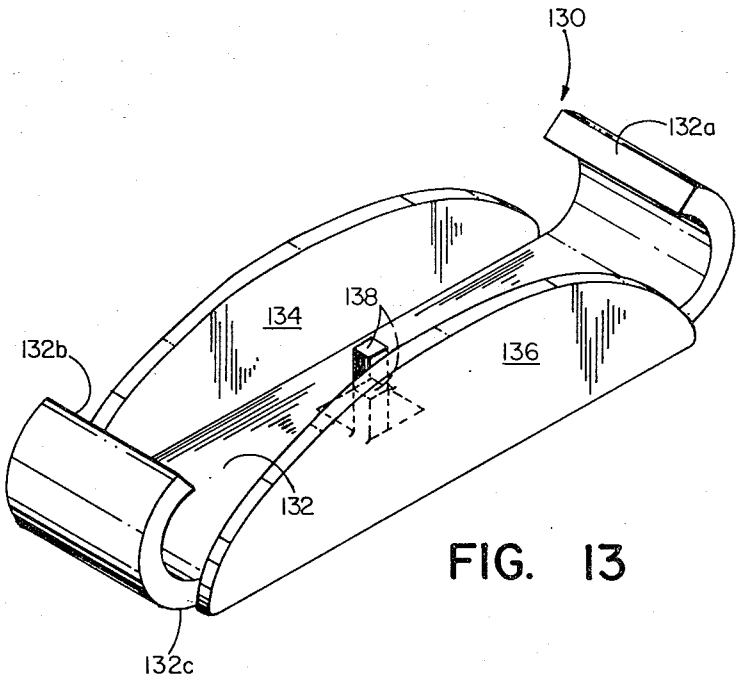
FIG. 13 is a perspective view of the movable contact element illustrated in the switch of FIGS. 9–11.

FIG. 12 shows strut 150 in some detail, but it should be noted that this strut 150 is similar to the strut 50 of the FIGS. 1–8 embodiment except for these projecting portions 154*a* and 156*a*. Pushbutton 140 is identical to the pushbutton 40 shown and described with reference to FIG. 7. That is, pushbutton 140 has a downwardly open recess 142 for loosely retaining the upper end or head portion 152 of the strut 150. Compression spring 60 serves the same function as in the previously described switch embodiment, that is to act between the underside of strut head portion 152 and the center of movable contact element 130. Thus, the spring 60 not only serves as a return spring for the pushbutton 140, but also serves to hold movable element 130 in the two limit positions (one of which is shown in FIG. 9, and the other of which positions is a mirror image thereof, being similar to that depicted in FIG. 3).

The movable contact element 130 of the switch shown in FIGS. 9–13 does have the same general channel shape as the element 30 of FIGS. 4 and 5 and in that a generally flat bottom wall 132 has upwardly bent tangs 138, 138 to receive the lower end of the spring 60. The upper edges of side walls 134 and 136 define camming surfaces for engagement with the lower ends of the staple strut 150. By way of comparison between FIG. 1 and FIG. 9 it will be apparent that in both switch constructions the lower ends of the staple strut legs follow the upper edges as the pushbutton is depressed. As the movable contact element 30 approaches the FIG. 2 position however the lower end no longer enages the upturned end portion to positively control further movement of the element 30 into the FIG. 3 position.

Figure 10:
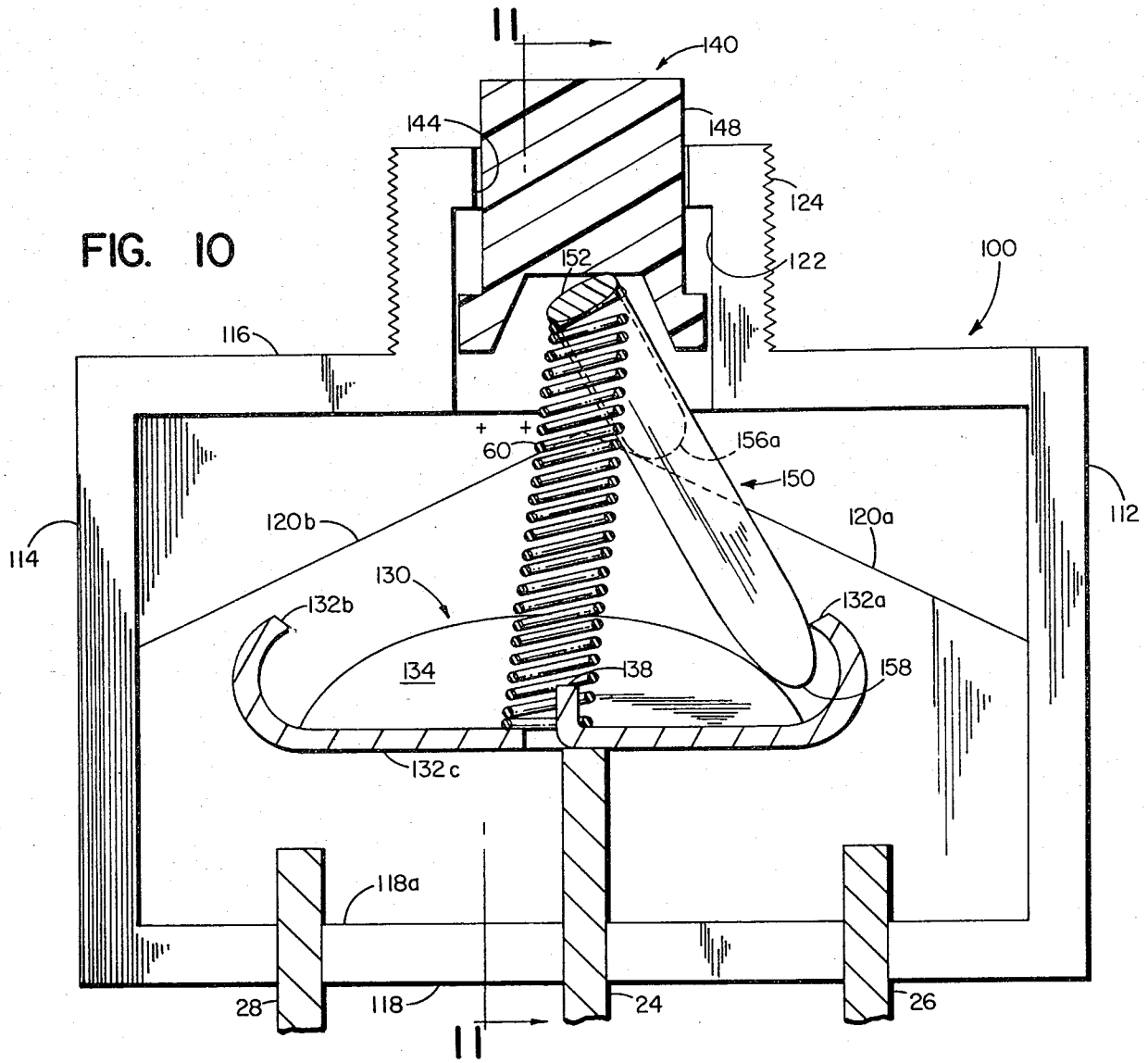
FIG. 10 is a view similar to FIG. 9 but illustrating the component parts of the FIG. 9 switch in an intermediate position similar to that of the FIG. 2 position for the FIG. 1 switch.

In the switch of FIGS. 9–13 however contact element 130 is positively moved toward the right (See FIG. 10) because strut 150 is not only moving down (as a result of pushbutton 140) but this strut 50 is also more positively pivoted so that its lower end 158 remains in engagement with the upstanding end portion **132*a* as the contact 130 moves through this FIG. 10 position. Compare this positive control over contact element 130 to that of the element 30 in FIG. 2**.

This positive pivotal movement of strut 150, as it moves downwardly (See FIG. 10), is due to engagement of inclined surfaces **120*a*, 120*a* by the projections 154*a* and 156*a* on strut leg portions 154 and 156 respectively. Once pushbutton 140 has moved down far enough so that these projections 154*a* and 156*a* engage one or the other of the surfaces 120*a* or 120*b* strut 150 is positively pivoted to cause contact element 130 to be moved laterally as a result of the lower ends 158, 158 of strut 150 engaging one or the other of the upstanding end portions 132*a* or 132*b* of this movable contact element 130**.

I claim:

1. A pushbutton switch assembly comprising a switch housing having a boss defining an opening, a pushbutton slidably received in said opening for movement from and to a normal position, said housing having an internal cavity communicating with said opening, fixed contacts in the bottom wall of said housing cavity and including a center fixed contact having its upper end located above the upper end of another of said fixed contacts, a movable contact element in said cavity and having a lower surface in sliding engagement with said upper end of said fixed contact, strut means acting between said movable contact element and said pushbutton to cause pivotal movement of the contact element in response to downward movement of said pushbutton, a spring acting between said contact element and an upper end of said strut means to return said pushbutton to said normal position, said strut means having said upper end loosely received in a downwardly open recess in said pushbutton, and said contact element having an upper camming surface engaging the lower end of said strut means.

2. The switch according to claim 1 wherein said movable contact element comprises a generally channel shaped element having a bottom wall defining said element lower surface, and upstanding side walls of said channel shaped element defining said upper camming surface at the upper edges thereof.

3. The switch according to claim 2 wherein said strut means comprises a generally staple shaped element having a head portion defining said upper end loosely received in said downwardly open pushbutton recess, and said staple shaped strut element having depending leg portions defining said lower end and engaging said upper camming surface edges of said channel shaped movable contact element.

4. The switch according to claim 3 wherein said spring comprises a coil compression spring provided between said staple leg portions and with its upper end in engagement with the underside of said staple head portion, said bottom wall of said channel shaped contact element defining spring seating means located in centered relation thereon to retain the lower end of said spring for movement with said movable contact element.

5. The switch according to claim 1 wherein said housing bottom wall includes ramp surfaces sloping downwardly from the upper end of said center contact for engaging the lower surface of said movable contact element to restrict the pivotal movement of said element to a predetermined angular range and to cause said movable contact element to slide relative to said center fixed contact as said contact element bridges said fixed contacts.

6. The switch according to claim 5 wherein said camming surface includes a continuously curved convex center segment such that said lower end of said strut means is cammed away from the plane of said center contact as said pushbutton is moved downwardly and such that said lower end of said strut means moves back across said center contact plane as said pushbutton returns upwardly to said normal position.

7. The switch according to claim 6 wherein said camming surface includes concave end segments continuously contoured with respect to said convex center segment and adapted to stop said strut means during movement back across the plane of said center contact, said strut means in said stopped condition being in position for achieving pivotal movement of said movable element in the opposite direction in response to downward movement of said pushbutton.

8. The switch according to claim 7 wherein said movable contact element comprises a generally channel shaped element having a bottom wall defining said element lower surface, and upstanding side walls of said channel shaped element defining said upper camming surface at the upper edges thereof.

9. The switch according to claim 8 wherein said strut means comprises a generally staple shaped element having a head portion defining said upper end and loosely received in said downwardly open pushbutton recess, and said staple shaped strut element having depending leg portions defining said lower end and engaging said upper camming surface edges of said channel shaped movable contact element.

10. The switch according to claim 9 wherein said spring comprises a coil compression spring provided between said staple leg portions and with its upper end in engagement with the underside of said staple head portion, said bottom wall of said channel shaped contact element defining spring seating means located in centered relation thereof to retain the lower end of said spring for movement with said movable contact element.

11. The switch according to claim 1 wherein said housing defines oppositely inclined ramp surfaces which slope downwardly and outwardly with respect to a vertical plane through said center fixed contact, and said strut means defining laterally projecting ramp abutment means for engaging said ramp surfaces as a result of further downward movement of said pushbutton beyond that sufficient to cause said above mentioned pivotal movement of said contact element.

12. The switch according to claim 11 wherein said movable contact element comprises a generally channel shaped element having a bottom wall defining said element lower surface, and upstanding side walls of said channel shaped element defining said upper camming surface at the upper edges thereof.

13. The switch according to claim 12 wherein said strut means comprises a generally staple shaped element having a head portion defining said upper end loosely received in said downwardly open pushbutton recess, and said staple shaped strut element having depending leg portions defining said lower end and engaging said upper camming surface edges of said channel shaped movable contact element.

14. The switch according to claim 13 wherein said spring comprises a coil compression spring provided between said staple leg portions and with its upper end in engagement with the underside of said staple head portion, said bottom wall of said channel shaped contact element defining spring seating means located in centered relation thereon to retain the lower end of said spring for movement with said movable contact element.

15. The switch according to claim 14 wherein said camming surface includes a continuously curved convex center segment such that said lower end of said strut means is cammed away from the plane of said center contact as said pushbutton is moved downwardly and such that said lower end of said strut means moves back across said center contact plane as said pushbutton returns upwardly to said normal position.

16. The switch according to claim 15 wherein said movable contact element has upturned end portions which are engaged by said strut lower ends and are moved in response to said further downward movement of said pushbutton and said engagement between said ramp surfaces in said housing and said projecting abutment means in said strut means, said upturned end portions also serving to stop said strut means during movement back across the plane of said center contact, and said strut means in said stopped condition being in position for achieving pivotal movement of said contact element in the opposite direction in response to initial downward movement of said pushbutton.

* * * * *